US011457685B2

(12) United States Patent
Bruce et al.

(10) Patent No.: US 11,457,685 B2
(45) Date of Patent: Oct. 4, 2022

(54) DOUBLE LAYER, SINGLE TUBE BRAID FOR FOOTWEAR UPPER

(71) Applicant: NIKE, Inc., Beaverton, OR (US)

(72) Inventors: Robert M. Bruce, Portland, OR (US); Eun Kyung Lee, Beaverton, OR (US); James Y. Yoo, Beaverton, OR (US); Chikao Ichikawa, Gunma (JP); Michihiro Ichikawa, Gunma (JP)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/991,840

(22) Filed: May 29, 2018

(65) Prior Publication Data

US 2018/0343957 A1 Dec. 6, 2018

Related U.S. Application Data

(60) Provisional application No. 62/512,499, filed on May 30, 2017.

(51) Int. Cl.
*A43B 1/04* (2022.01)
*D04C 1/06* (2006.01)
(Continued)

(52) U.S. Cl.
CPC ..... *A43B 1/04* (2013.01); *A43B 23/024* (2013.01); *A43B 23/0205* (2013.01);
(Continued)

(58) Field of Classification Search
CPC ... D04C 1/06; D04C 1/08; D04C 1/10; D04C 3/06; D04C 3/40; A43B 1/04;
(Continued)

(56) References Cited

U.S. PATENT DOCUMENTS 787,382 A * 4/1905 Klein ..... D04C 1/06 87/9
933,340 A * 9/1909 Rahm ..... D04C 3/00 87/37

(Continued)

FOREIGN PATENT DOCUMENTS

CN 1802104 A 7/2006
CN 202588461 U 12/2012

(Continued)

OTHER PUBLICATIONS

International Preliminary Report on Patentability dated Dec. 12, 2019 in International Patent Application No. PCT/US2018/035426, 7 pages.

(Continued)

*Primary Examiner* — Khoa D Huynh
*Assistant Examiner* — Uyen T Nguyen
(74) *Attorney, Agent, or Firm* — Shook Hardy & Bacon, L.L.P.

(57) ABSTRACT

A method of manufacturing a braided footwear upper is provided. The method includes braiding a two-layer, single-tube structure with a first end that couples a first braided layer to a second braided layer, and second end that couples the first braided layer to the second braided layer of the tubular braided structure. The first end is proximate the second end. At least one yarn from the first end, and at least one yarn from the second end are braided with at least one draw yarn. The draw yarn is braided to be easily removable, such that the first end is selectively de-coupled from the second end. When the draw yarn is removed, the double-layer tubular braided structure is expandable to form a larger diameter tubular braided structure.

9 Claims, 8 Drawing Sheets

(51) Int. Cl.

| | |
|---|---|
| ***D04C 3/08*** | (2006.01) |
| ***A43B 23/02*** | (2006.01) |
| ***D04C 3/40*** | (2006.01) |
| ***A43B 23/04*** | (2006.01) |
| ***D04C 1/08*** | (2006.01) |

(52) U.S. Cl.
CPC ..... *A43B 23/0245* (2013.01); *A43B 23/0265* (2013.01); *A43B 23/042* (2013.01); *D04C 1/06* (2013.01); *D04C 1/08* (2013.01); *D04C 3/08* (2013.01); *D04C 3/40* (2013.01); *D10B 2403/023* (2013.01); *D10B 2403/033* (2013.01); *D10B 2501/043* (2013.01)

(58) Field of Classification Search
CPC . A43B 23/024; A43B 23/0245; A43B 23/042; A43B 23/0205; A43B 23/0265; A43B 23/02; A41B 11/02; A41B 11/04; D03D 3/02
USPC ..... 36/45
See application file for complete search history.

(56) References Cited

U.S. PATENT DOCUMENTS

| | | | | |
|---|---|---|---|---|
| 4,686,134 | A | 8/1987 | Ono | |
| 5,067,525 | A | 11/1991 | Tsuzuki et al. | |
| 5,287,790 | A * | 2/1994 | Akiyama | D04C 3/48 87/9 |
| 5,348,056 | A | 9/1994 | Tsuzuki | |
| 5,385,077 | A | 1/1995 | Akiyama et al. | |
| 5,396,829 | A * | 3/1995 | Akiyama | B29C 70/16 87/29 |
| 5,398,586 | A | 3/1995 | Akiyama et al. | |
| 5,415,204 | A * | 5/1995 | Kitamura | D03D 3/02 139/55.1 |
| 5,476,027 | A | 12/1995 | Uchida et al. | |
| 6,024,005 | A | 2/2000 | Uozumi | |
| 6,161,399 | A | 12/2000 | Jayaraman | |
| 9,295,575 | B1 | 3/2016 | Dignam et al. | |
| 10,060,056 | B1 * | 8/2018 | Head | D04C 3/08 |
| 10,455,885 | B2 | 10/2019 | Tamm | |
| 10,499,707 | B2 | 12/2019 | Hobson et al. | |
| 10,555,581 | B2 | 2/2020 | Bruce et al. | |
| 2003/0089000 | A1 | 5/2003 | Tseng | |
| 2005/0284002 | A1 | 12/2005 | Aveni | |
| 2007/0094892 | A1 * | 5/2007 | Craig | A41B 11/02 36/10 |
| 2008/0110049 | A1 | 5/2008 | Sokolowski et al. | |
| 2010/0107443 | A1 | 5/2010 | Aveni | |
| 2010/0322776 | A1 * | 12/2010 | Laurent | B29C 70/545 416/230 |
| 2012/0271403 | A1 | 10/2012 | Gries | |
| 2013/0260104 | A1 | 10/2013 | Dua et al. | |
| 2013/0269209 | A1 | 10/2013 | Tamm et al. | |
| 2013/0305465 | A1 | 11/2013 | Siegismund | |
| 2014/0054214 | A1 | 2/2014 | Bator | |
| 2014/0137434 | A1 * | 5/2014 | Craig | A43B 23/04 66/170 |
| 2014/0157974 | A1 | 6/2014 | Cahuzac | |
| 2014/0196311 | A1 | 7/2014 | Follet et al. | |
| 2014/0196316 | A1 | 7/2014 | Follet | |
| 2014/0223671 | A1 | 8/2014 | Fisher et al. | |
| 2014/0245578 | A1 * | 9/2014 | Greenwood | D04B 15/80 66/170 |
| 2014/0256202 | A1 * | 9/2014 | Laurent | D06H 5/002 442/304 |
| 2014/0310984 | A1 | 10/2014 | Tamm et al. | |
| 2014/0310986 | A1 | 10/2014 | Tamm et al. | |
| 2014/0373389 | A1 | 12/2014 | Bruce | |
| 2014/0377488 | A1 * | 12/2014 | Jamison | D04C 1/10 428/221 |
| 2015/0007451 | A1 | 1/2015 | Bruce | |
| 2015/0201707 | A1 * | 7/2015 | Bruce | A43B 23/042 36/47 |
| 2015/0218737 | A1 * | 8/2015 | Blakely | A41D 31/102 428/131 |
| 2015/0223552 | A1 | 8/2015 | Love et al. | |
| 2015/0272274 | A1 | 10/2015 | Berns et al. | |
| 2016/0076178 | A1 | 3/2016 | Head et al. | |
| 2016/0095377 | A1 | 4/2016 | Tamm | |
| 2016/0168769 | A1 | 6/2016 | McDonnell | |
| 2016/0213095 | A1 | 7/2016 | Kohatsu et al. | |
| 2016/0289873 | A1 | 10/2016 | Head | |
| 2016/0298267 | A1 | 10/2016 | Feeney et al. | |
| 2016/0309843 | A1 | 10/2016 | Song et al. | |
| 2016/0316855 | A1 | 11/2016 | Berns et al. | |
| 2016/0316856 | A1 | 11/2016 | Berns et al. | |
| 2016/0345674 | A1 | 12/2016 | Bruce et al. | |
| 2016/0345676 | A1 | 12/2016 | Bruce et al. | |
| 2017/0021141 | A1 * | 1/2017 | Osbrink | A61M 25/10 |
| 2017/0035149 | A1 * | 2/2017 | Bruce | D04C 1/08 |
| 2017/0156434 | A1 | 6/2017 | Tamm et al. | |
| 2017/0342612 | A1 * | 11/2017 | Kawakami | D04B 15/10 |
| 2018/0049509 | A1 | 2/2018 | Zwick et al. | |
| 2018/0279720 | A1 | 10/2018 | Iuchi et al. | |
| 2018/0343958 | A1 | 12/2018 | Bruce et al. | |
| 2018/0343959 | A1 | 12/2018 | Bruce et al. | |
| 2018/0343960 | A1 | 12/2018 | Bruce et al. | |
| 2019/0017205 | A1 | 1/2019 | Luedecke et al. | |
| 2019/0110557 | A1 | 4/2019 | Hobson et al. | |
| 2019/0203389 | A1 | 7/2019 | Liu | |
| 2019/0208862 | A1 | 7/2019 | Poegl et al. | |
| 2019/0343216 | A1 | 11/2019 | Huffa et al. | |
| 2019/0350303 | A1 | 11/2019 | Huffa et al. | |
| 2019/0380424 | A1 | 12/2019 | Tamm et al. | |

FOREIGN PATENT DOCUMENTS

| | | | |
|---|---|---|---|
| CN | 202603767 | U | 12/2012 |
| CN | 103462296 | A | 12/2013 |
| CN | 203765212 | U | 8/2014 |
| CN | 104708858 | A | 6/2015 |
| CN | 204430643 | U | 7/2015 |
| CN | 105246362 | A | 1/2016 |
| CN | 205197134 | U | 5/2016 |
| CN | 105996284 | A | 10/2016 |
| CN | 106418902 | A | 2/2017 |
| EP | 0806596 | A1 | 11/1997 |
| EP | 1486601 | B1 | 9/2007 |
| EP | 2657384 | A1 | 10/2013 |
| EP | 2862969 | A1 | 4/2015 |
| GB | 410261 | A | 5/1934 |
| TW | M451012 | U1 | 4/2013 |
| WO | 2014209596 | A1 | 12/2014 |
| WO | 2016093948 | A1 | 6/2016 |
| WO | 2016191478 | A1 | 12/2016 |
| WO | 2016196132 | A1 | 12/2016 |
| WO | 2017027284 | A1 | 2/2017 |
| WO | 2017027285 | A1 | 2/2017 |

OTHER PUBLICATIONS

International Preliminary Report on Patentability dated Dec. 12, 2019 in International Patent Application No. PCT/US2018/035116, 8 pages.
International Preliminary Report on Patentability dated Dec. 12, 2019 in International Patent Application No. PCT/US2018/035413, 9 pages.
International Preliminary Report on Patentability dated Dec. 12, 2019 in International Patent Application No. PCT/US2018/035113, 10 pages.
Non-Final Office Action received for U.S. Appl. No. 15/991,844, dated Aug. 6, 2020, 11 pages.
Notice of Allowance received for U.S. Appl. No. 15/991,846, dated Jul. 20, 2020, 8 pages.
Final Office Action received for U.S. Appl. No. 15/991,844, dated May 6, 2020, 11 pages.
Non-Final Office Action received for U.S. Appl. No. 15/991,844, dated Jan. 24, 2020, 9 pages.

(56) References Cited

OTHER PUBLICATIONS

Non-Final Office Action received for U.S. Appl. No. 15/991,846, dated Apr. 9, 2020, 11 pages.
Non-Final Office Action received for U.S. Appl. No. 15/991,847, dated Mar. 19, 2020, 16 pages.
Intention to Grant received for European Patent Application No. 18733417.2, dated Nov. 4, 2020, 8 pages.
Final Office Action received for U.S. Appl. No. 15/991,844, dated Oct. 16, 2020, 13 pages.
Final Office Action received for U.S. Appl. No. 15/991,847, dated Oct. 22, 2020, 16 pages.
Non-Final Office Action received for U.S. Appl. No. 15/991,847 , dated Jun. 9, 2021, 12 pages.
Intention to Grant received for European Patent Application No. 18733438.8, dated Sep. 9, 2021, 5 pages.
Office Action received for European Patent Application No. 18733416.4, dated Aug. 20, 2021, 10 pages.

* cited by examiner

DOUBLE LAYER, SINGLE TUBE BRAID FOR FOOTWEAR UPPER

CROSS-REFERENCE TO RELATED APPLICATIONS

This application is a non-provisional application which claims the benefit of U.S. Provisional Application 62/512,499 filed on May 30, 2017 and entitled Double Layer, Single Tube Braid for Footwear Upper. The entirety of the aforementioned application is incorporated by reference herein.

TECHNICAL FIELD

Aspects herein relate to a braided structure that forms a footwear upper. In further aspects, a braided footwear upper is constructed on a circular braiding machine in a double-layer configuration such that, upon removal of a draw yarn, the double-layer tube opens to form a single-layer tubular braided upper.

BACKGROUND

Traditional shoes are often made from textiles or materials that have uppers that are cut to a desired shape and stitched together. Newer methods also now include forming shoe uppers from a knitted textile. Still newer methods involve braiding a tubular textile for use as the shoe upper. Aspects herein relate to braiding tubular structures that in some aspects are used in articles of footwear.

BRIEF SUMMARY

This Summary provides a high-level overview of the disclosure and introduces a selection of concepts that are further described in the Detailed Description below. This Summary is not intended to identify key features or essential features of the claimed subject matter, nor is it intended to be used as an aid in isolation to determine the scope of the claimed subject matter.

Aspects herein generally relate to a method of manufacturing a double-layer tubular braid structure for a braided footwear upper. The method includes braiding a two-layer, single-tube structure. The double-layer structure, in some aspects, has a closed first end that couples a first braided layer to a second braided layer of the tubular braided structure, and a closed second end that couples the first braided layer to the second braided layer of the tubular braided structure. The closed first end is proximate the closed second end. At least one yarn from the closed first end is braided with at least one draw yarn. Similarly, at least one yarn from the closed second end is braided with the at least one draw yarn. The draw yarn is braided to be easily removable, such that the closed first end is selectively de-coupled from the closed second end. When the draw yarn is removed, the double-layer tubular braided structure is expandable to form a larger diameter (single-layer) tubular braided structure. Upon removal of at least a portion of the draw yarn the first layer of the double-layer, single-tube braid structure forms a lateral side of a braided shoe upper, and a second layer of the two-layer, single-tube braid structure forms a medial side of a braided shoe upper.

In some aspects, the first closed end of the tubular braided structure is instead braided to be open, rather than closed. In this aspect, the first open end presents a first finished edge and a second finished edge. The first finished edge and the second finished edge are braided with the draw yarn to removably couple the first finished edge, the second finished edge and the second closed end together to form the double-layer tubular braided structure. In this aspect, when the draw yarn is removed, the double-layer tubular braided structure is expandable to form a larger diameter (single-layer) tubular braided structure with an opening in a selected location, such as the throat of an upper.

In some aspects, the double-layer tubular braided structure is formed with a first section having first and second closed ends, and a second section having an open first end and a closed second end. In still further aspects, the double-layer tubular braided structure is formed with a first braid density in one area and a second braid density different than the first braid density in another area. In some aspects, the double-layer tubular braided structure is braided to have a higher density braid in a band proximate the first finished edge and the second finished edge, where the first finished edge and the second finished edge are formed along the throat of a shoe upper. In some aspects the first finished edge and the second finished edge form parallel, spaced apart eyestay edges.

BRIEF DESCRIPTION OF THE DRAWINGS

Aspects herein is described in detail below with reference to the attached drawing figures, wherein.

DETAILED DESCRIPTION

Figure 1:
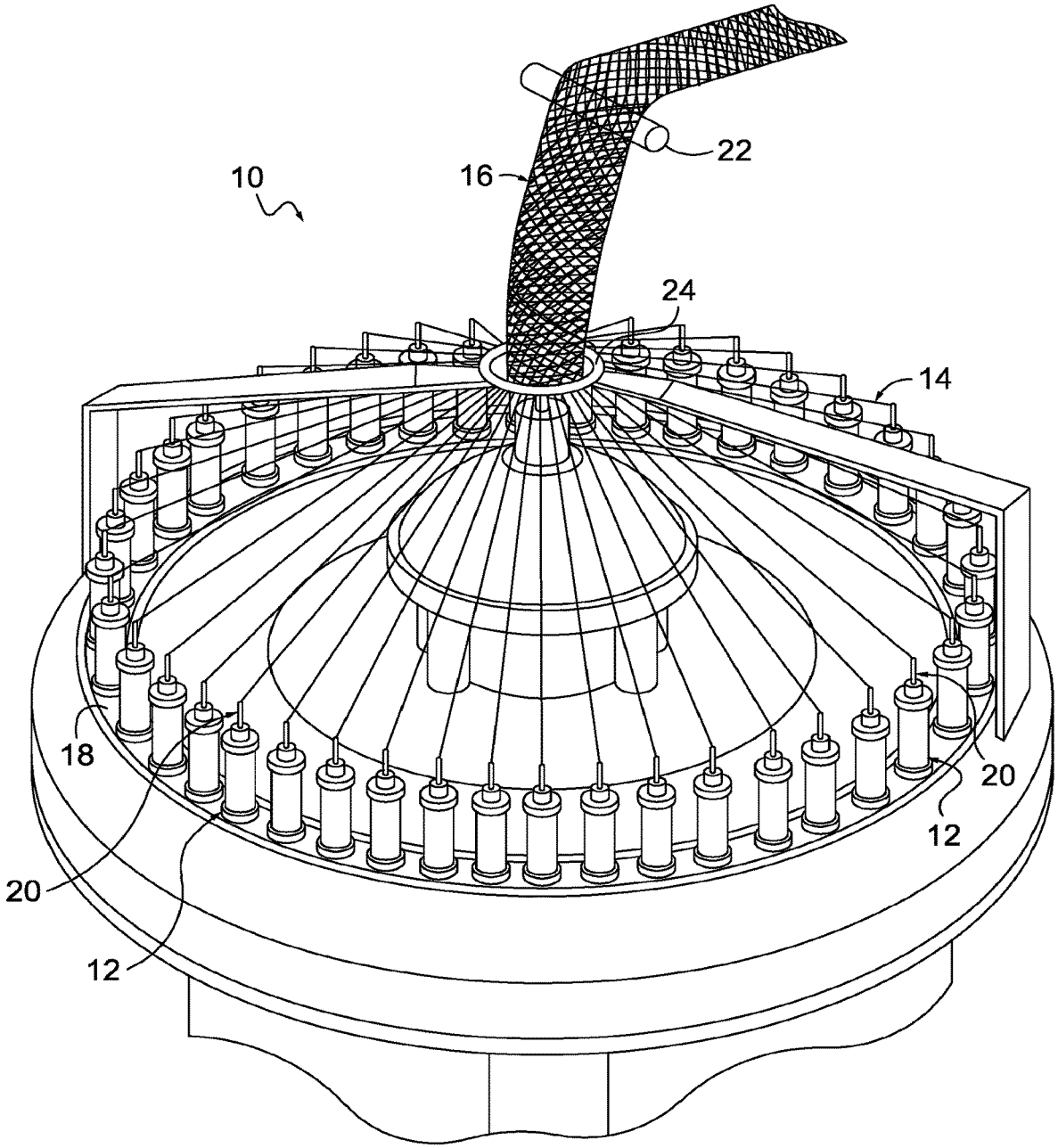
FIG. 1 depicts a schematic view of an exemplary braiding machine.

Aspects herein generally provide a method of manufacturing a double-layer tubular braid structure for a braided footwear upper. The method includes braiding a two-layer, single-tube structure. The double-layer structure, in some aspects, has a closed first end that couples a first braided layer to a second braided layer of the tubular braided structure, and a closed second end that couples the first braided layer to the second braided layer of the tubular braided structure. The closed first end is proximate the closed second end. At least one yarn from the closed first end is braided with at least one draw yarn. Similarly, at least one yarn from the closed second end is braided with the at least one draw yarn. The draw yarn is braided to be easily removable, such that the closed first end is selectively de-coupled from the closed second end. When the draw yarn is removed, the double-layer tubular braided structure is expandable to form a larger diameter tubular braided structure. Upon removal of at least a portion of the draw yarn the first layer of the double-layer, single-tube braid structure forms a lateral side of a braided shoe upper, and a second layer of the two-layer, single-tube braid structure forms a medial side of a braided shoe upper.

In some aspects, the first closed end of the tubular braided structure is instead braided to be open, rather than closed. In this aspect, the first open end presents a first finished edge and a second finished edge. The first finished edge and the second finished edge are braided with the draw yarn to removably couple the first finished edge, the second finished edge and the second closed end together to form the double-layer tubular braided structure. In this aspect, when the draw yarn is removed, the double-layer tubular braided structure is expandable to form a larger diameter tubular braided structure with an opening in a selected location, such as the throat of an upper. In some aspects, the double-layer tubular braided structure is formed with a first section having first and second closed ends, and a second section having an open first end and a closed second end. In some aspects, the double-layer tubular braided structure is braided to have a higher density braid in a band proximate the first finished edge and the second finished edge, where the first finished edge and the second finished edge are formed along the throat of a shoe upper. In some aspects the first finished edge and the second finished edge form parallel, spaced apart eyestay edges.

Braiding is a process of interlacing or interweaving three or more yarns diagonally to a product axis in order to obtain a thicker, wider or stronger product or in order to cover (overbraid) some profile. Interlacing diagonally means that the yarns make an angle with the product axis, which can be between 1° and 89° but is usually in the range of 30°-80°. This angle is called the braiding angle. Braids can be linear products (ropes), hollow tubular shells or solid structures (one, two or three-dimensional textiles) with constant or variable cross-section, and of closed or open appearance.

As used herein, the yarns used for braiding may be formed of different materials having different properties. The properties that a particular yarn will impart to an area of a braided component partially depend upon the materials that form the yarn. Cotton, for example, provides a softer product, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarn selected for formation of a braided component may affect the properties of the braided component. For example, a yarn may be a monofilament or a multifilament. The yarn may also include separate filaments that are each formed of different materials. In addition, the yarn may include filaments that are each formed of two or more different materials, such as a bicomponent yarn with filaments having a sheath-core configuration or two halves formed of different materials.

As stated above, braided structures can be formed as tubular braids on a braiding machine, such as a radial, axial or lace braiding machine. One example of a lace braiding machine can be found in Ichikawa, EP 1 486 601, granted May 9, 2007 entitled "Torchon Lace Machine" and EP No. 2 657 384, published Oct. 30, 2013 entitled "Torchon Lace Machine," the entirety of which are hereby incorporated by reference. The upper portion of an exemplary braiding machine 10 is shown in FIG. 1. Braiding machine 10 includes a plurality of spools 12. In some embodiments, the spools 12 carry the yarn 14 selected for braiding. The yarns 14 from individual spools are selectively interlaced or intertwined with one another by the braiding machine 10. This interlacing or intertwining of strands forms a braided structure 16, as further described below. Each of the spools 12 is supported and constrained by a track 18 about the circumference of the braiding machine 10. Each spool 12 has a tensioner 20 (shown schematically in FIG. 1) that operates, along with a roller 22, to maintain a desired tension in the yarns 14 and the braided structure 16. As the yarns 14 extend upwardly, they pass through a braid ring 24 that is generally considered the braiding point. The braiding point is defined as the point or area where yarns 14 consolidate to form the braided structure 16. At or near the braid ring 24, the distance between yarns 14 from different spools 12 diminishes. As the distance between yarns 14 is reduced, the yarns 14 intermesh or braid with one another in a tighter fashion and are pulled linearly by roller 22.

Figure 2:
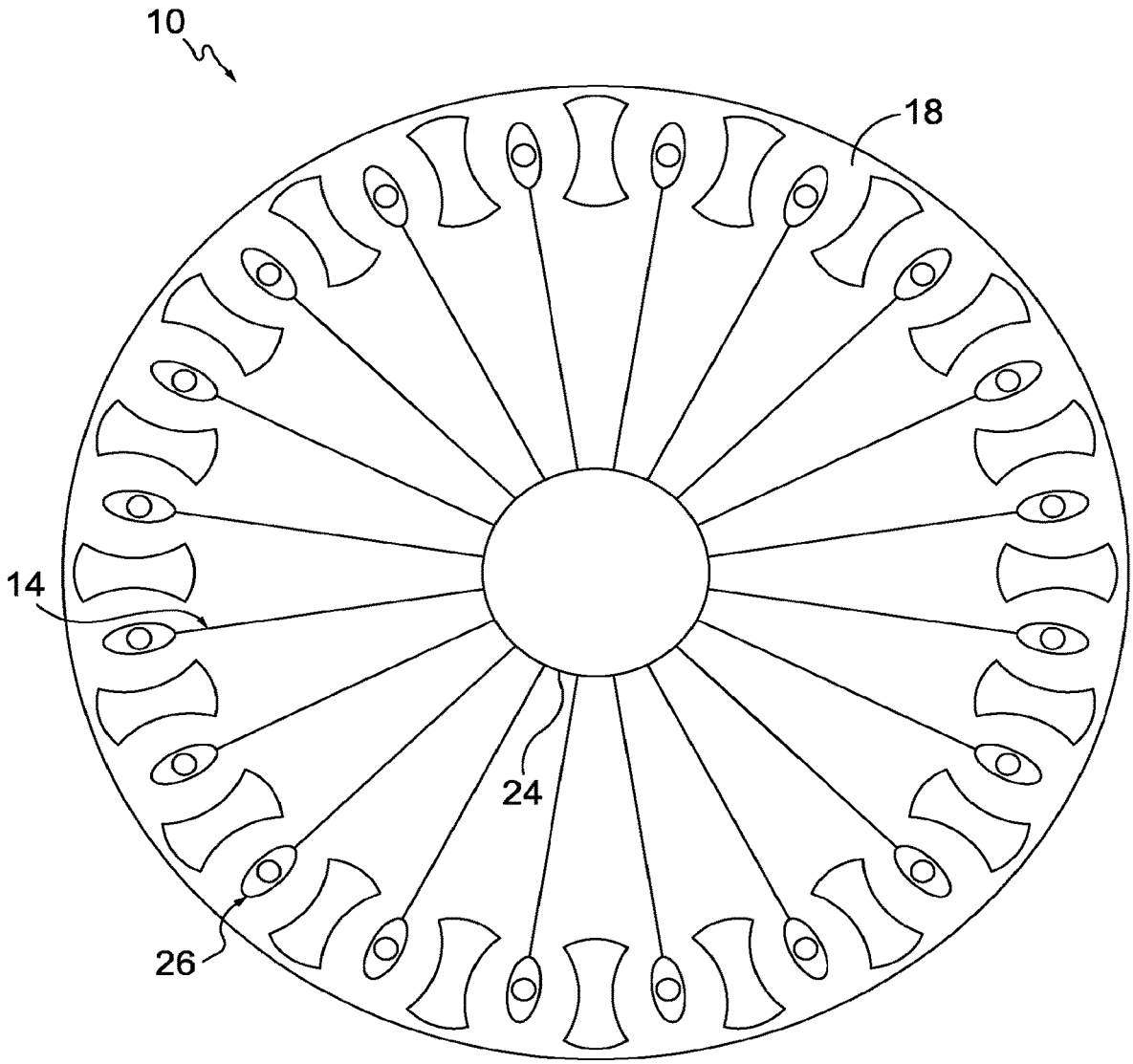
FIG. 2 depicts a schematic top view of an exemplary braiding machine, schematically illustrating the carriages and rotor metals.
Figure 3:
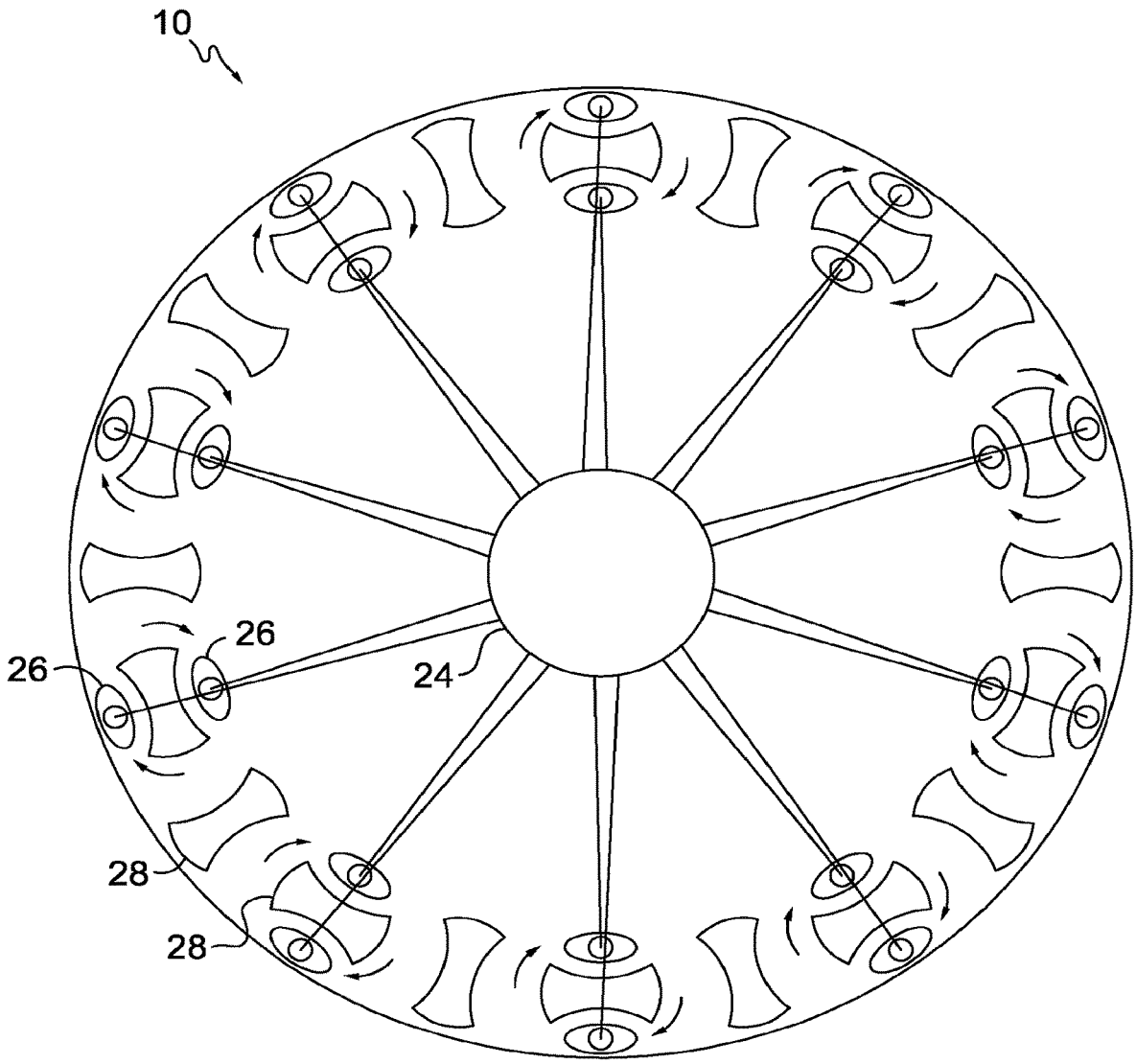
FIG. 3 depicts a view similar to FIG. 2, but with the rotor metals moving the carriages.
Figure 4:
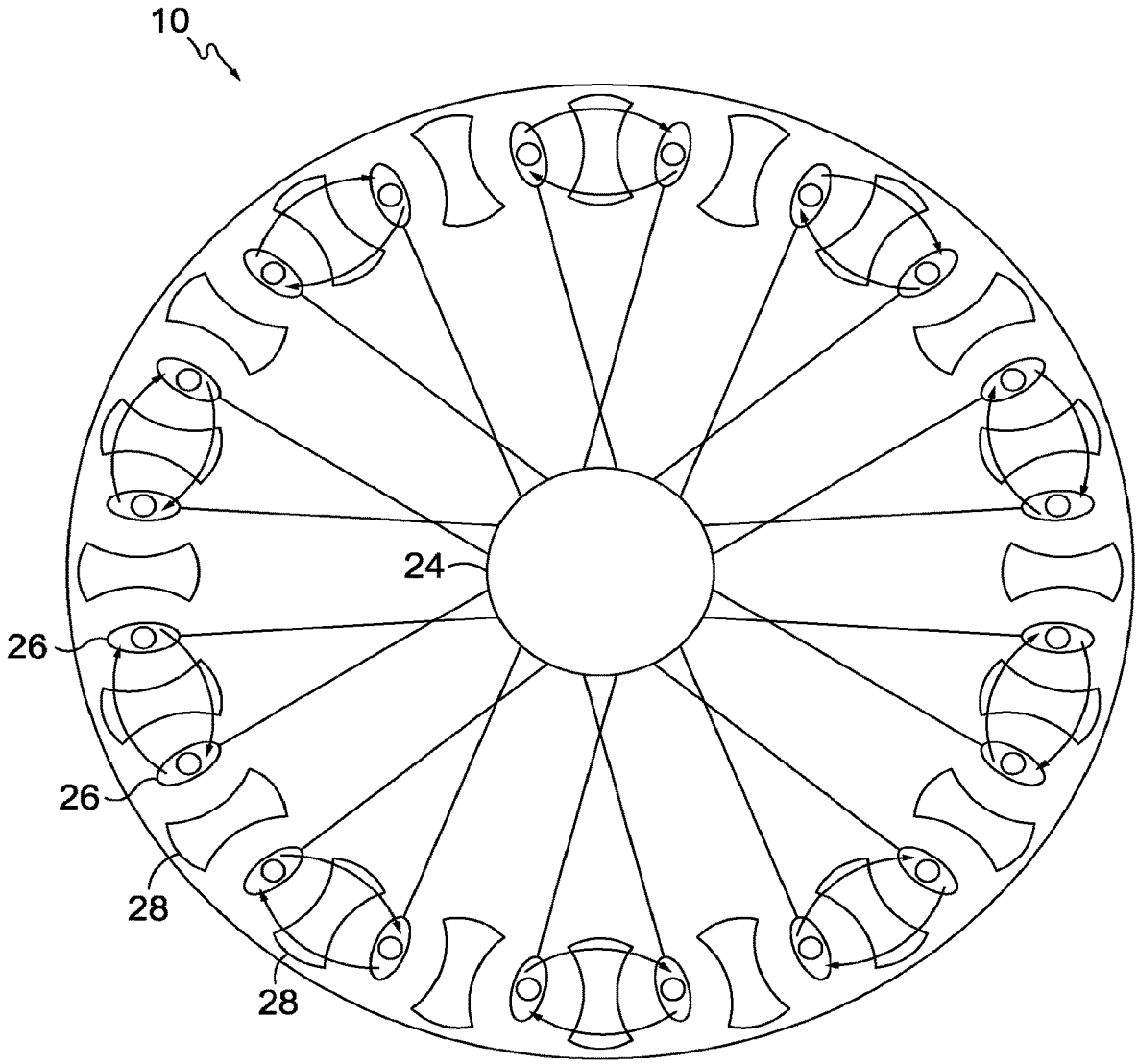
FIG. 4 depicts a view similar to FIG. 3, but showing the completion of the exemplary movement of FIG. 3.

As best seen in FIG. 2, each spool 12 is carried and supported by a carriage 26. Each spool 12 is movable about the circumference of the track 18 by rotor metals 28. As described on the Torchon Lace Machine referenced previously, and disclosed in EP 1 486 601, each of the rotor metals 28 can be moved clockwise or counterclockwise. In contrast to radial braiding machines or fully non-jacquard machines, in a lace braiding machine, each rotor metal is not intermeshed with the adjacent rotor metal. Instead, each rotor metal 28 may be selectively independently movable. As can be seen by comparing FIG. 2 to FIG. 4, as the rotor metals 28 rotate, they move the carriages 26, and thus the spools 12 supported on the carriages 26 by moving them about the circumference of the track 18. The braiding machine 10 is programmable such that the individual rotor metals 28 rotate the carriages 26, and thus the spools 12 to move them about the circumference of the track 18. As an individual spool 12 moves relative to an adjacent spool 12, the yarns 14 carried on the spools 12 interweave to create a desired braid pattern. The movement of spools 12 may be pre-programmed to form particular shapes, designs, and thread densities of a braided component or portions of a braided component. By varying the rotation and location of individual spools 12 various braid configurations may be formed. Such an exemplary braiding machine may form intricate braid configurations including both jacquard and non-jacquard braid configurations or geometries. Such configurations and geometries offer design possibilities beyond those offered by other textiles, such as knitting.

In some aspects, the size of braiding machine 10 may be varied. It should be understood that the braiding machine 10 shown and described is for illustrative purposes only. In some aspects, braiding machine 10 may be able to accept 144 carriages, although other sizes of braiding machines, carrying different numbers of carriages and spools is possible and is within the scope of this disclosure. By varying the number of carriages and spools within a braiding machine, the density of the braided structure as well as the size of the braided component may be altered.

Figure 5:
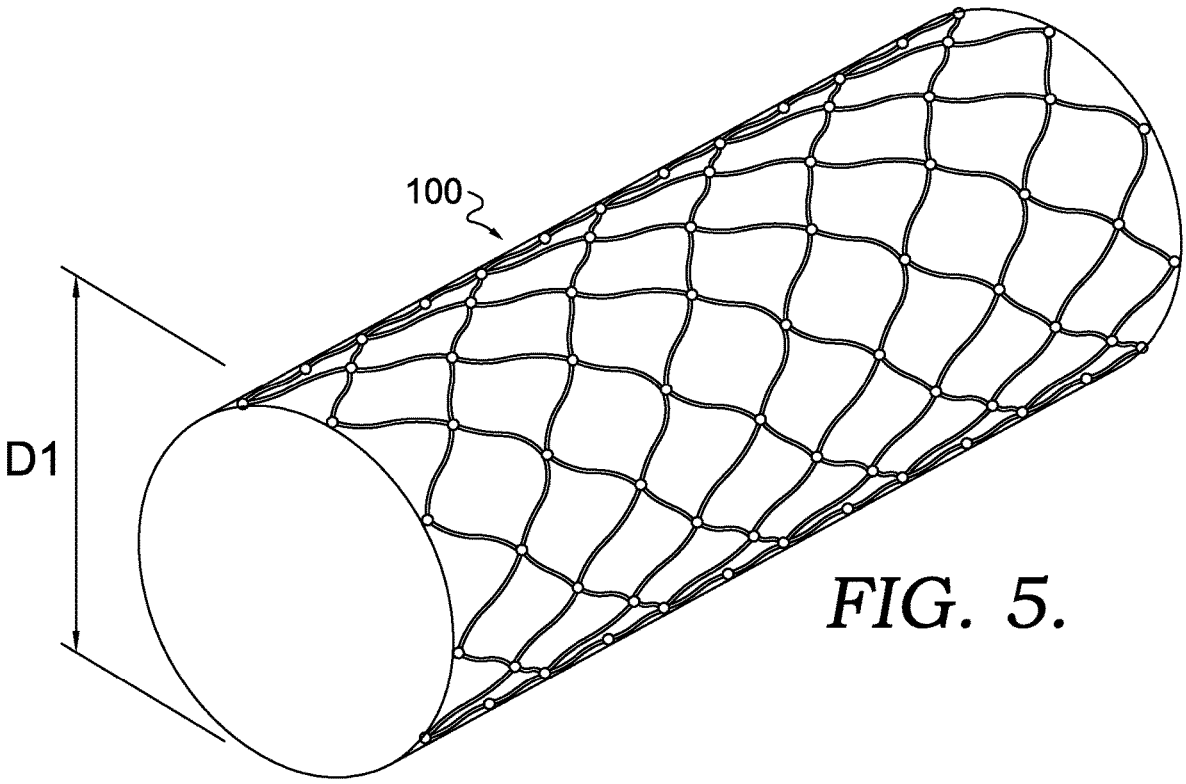
FIG. 5 depicts a perspective view of an exemplary single-layer tubular braided structure.

As shown in FIG. 5, an exemplary tubular braided structure 100 is shown. Braided structure 100 could be formed, for example, on a braiding machine, such as braiding machine 10 described above with a 144 spool construction. The exemplary tubular braided structure 100 is a single-layer tubular braided structure, leaving the braiding machine with a diameter D1. The tubular braided structure 100 is shown for comparison purposes to compare the single-layer tubular braided structure 100 of FIG. 5 with a double-layer tubular braided structure 110, shown in FIG. 6. The double-layer tubular braided structure 110 has a first braided layer 114, and a second braided layer 116. For clarity, the actual braiding shown in the figures is schematically depicted, to better reveal aspects of construction. The actual braid configuration or pattern could be any of a number of different braid configurations or patterns. The double-layer tubular braided structure 110 has the same outside diameter D1 as the single-layer tubular braided structure 100 shown in FIG. 5. Both braided structure 100 and braided structure 110 are braided on the same braiding machine 10, such as a 144 spool torchon lace braiding machine 10 that is described above. To braid the first layer 114 and the separate second layer 116, a portion of the spools 12 on machine 10 are used to braid first layer 114, and a different portion of the spools 12 are used to braid the second layer 116. In one section 112 of the braided structure 110, such as along line 7-7, first braided layer 114 and second braided layer 116 meet at a closed first end 118 and a closed second end 120. First end 118 and second end 120 are near each other as braided structure 110 is formed. As braided structure 110 is braided, in first section 112, first end 118 is removably coupled to second end 120 by one or more draw yarns 122. The draw yarn(s) 122 are selectively braided into first end 118 and second end 120 along the length of the opening spanning first end 118 and second end 120 to maintain the double-layer tubular structure in section 112 as braided structure 110 is formed. The draw yarn(s) 122 are meant to be removed from braided structure 110, as further described below.

Figure 6:
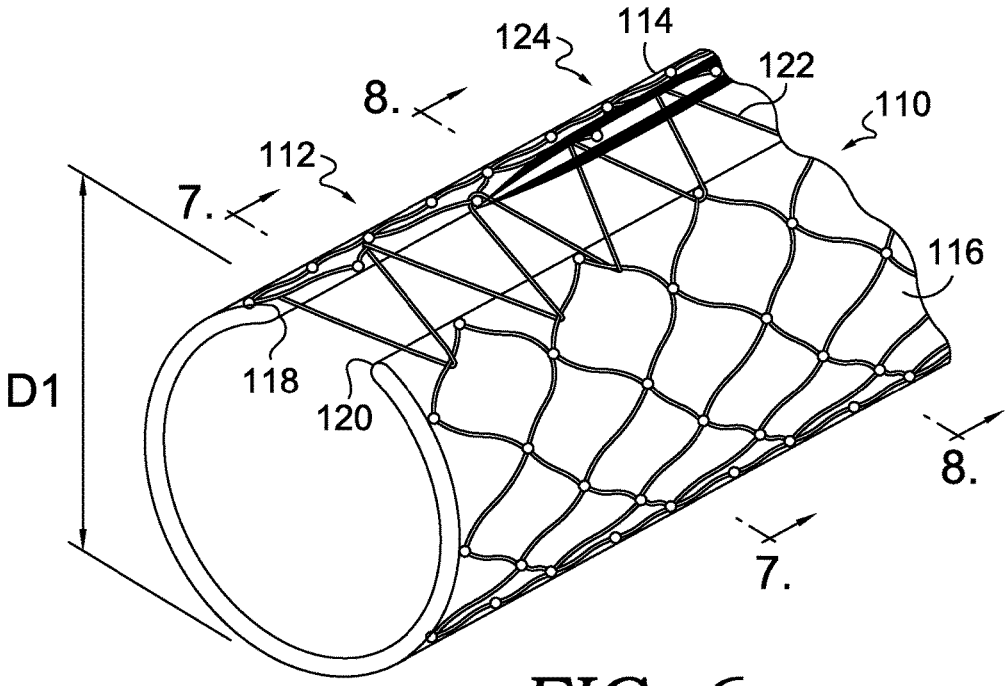
FIG. 6 depicts a perspective view of a section of an exemplary double-layer, single tube braided structure for forming a shoe upper, with the continuous tubular braided structure having one section with a pair of closed turnaround ends and a draw yarn, and a second section having one closed turnaround end, and one open turnaround end having two finished edges that are removably coupled with each other and the closed turnaround end by a draw yarn, in accordance with aspects herein.
Figure 8:
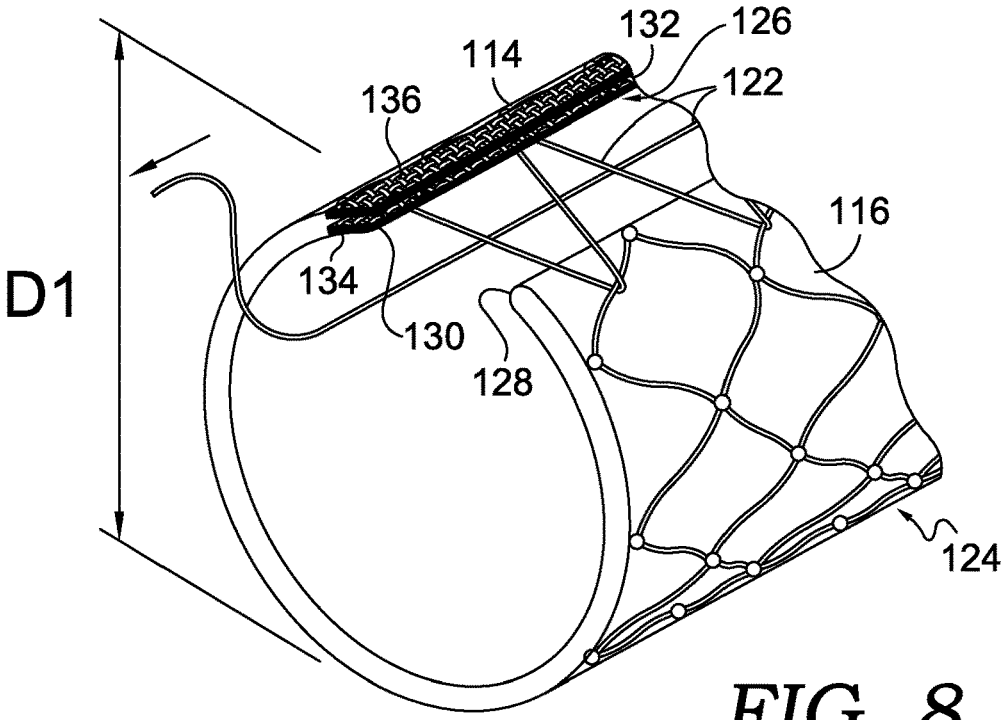
FIG. 8 depicts a perspective view of an exemplary section of the double-layer, single tube braided structure of claim 6, along line 8-8, in accordance with aspects herein.

As shown in FIGS. 6 and 8, braided structure 110 has, in some aspects, a second section 124, such as along line 8-8, where first braided layer 114 and second braided layer 116 do not meet at a first end 126. This second section 124 does include a closed second end 128 that is contiguous with closed second end 120. As best seen in FIG. 8, open first end 126 includes a finished edge 130 that is the terminal end of first braided layer 114. Similarly, open first end 126 includes a finished edge 132 that is the terminal end of second braided layer 116. Finished edge 130, in one aspect, may be braided with a higher density braid configuration in a band 134 of a selected width. Similarly, finished edge 132, in one aspect, may be braided with a higher density braid configuration in a band 136 of a selected width. In second section 124, draw yarn(s) 122 are selectively braided into finished edges 130, 132 and into closed second end 128. Thus, draw yarn(s) 122 hold structure 110 in a tubular form. As with section 112 described above, draw yarn(s) 122 are meant to be removed from braided structure 110.

Figure 10:
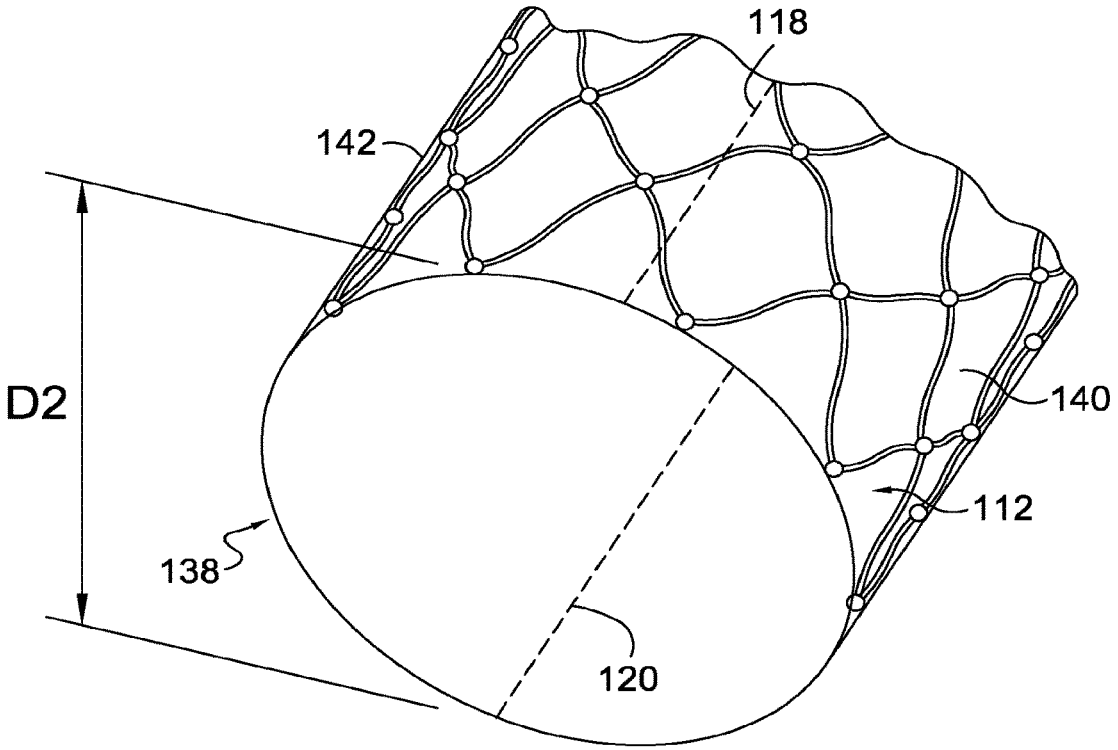
FIG. 10 depicts a perspective view of the an exemplary section of FIG. 9, along line 10-10, with the draw yarn removed and the tubular structure expanded, in accordance with aspects herein.

Removal of draw yarn(s) 122 allows expansion of tubular braided structure 110. As best seen in FIG. 10, with respect to first section 112, removal of draw yarn(s) 122 allows the double-layer tubular braided structure 110 to be expanded to a single-layer braided tube 138 having a diameter D2 roughly double that of D1. When used as an upper on an article of footwear, in one aspect, first end 118 will be oriented along the top center of the upper, and second end 120 will be oriented along the bottom center of the upper. While shown as a cylindrical tube in FIG. 10, the tube section 138 could also be manipulated to a more oval shape, to correspond to, for example, a toe area, as seen in FIG. 12 and further described below. In one aspect, as further-described below, expanded first section 112 could be used in the toe area of a shoe upper. In one aspect, first layer 114 forms the medial side 140 of the upper, and second layer 116 forms the lateral side 142 of the upper (or vice versa).

As best seen in FIG. 10, removal of draw yarn(s) 122, with respect to second section 124, allows the double-layer tubular braided structure 110 to be expanded to a single-layer braided tube 144 having a diameter D2 roughly double that of D1. When used as an upper on an article of footwear, in one aspect, closed second end 128 will be oriented along the bottom center of the upper. Open first end 126 creates a throat opening 150 for the upper, with finished edges 130, 132 running in spaced parallel relation. The high density bands 134, 136 create support for the throat opening 150 and could be braided with integral eyelets (as shown in FIG. 12), or could be later finished to include eyelets. In one aspect, expanded second section 124 could be used in the mid-foot area of a shoe upper. In one aspect, first layer 114 forms the medial side 140 of the upper, and second layer 116 forms the lateral side 142 of the upper (or vice versa).

Figure 7:
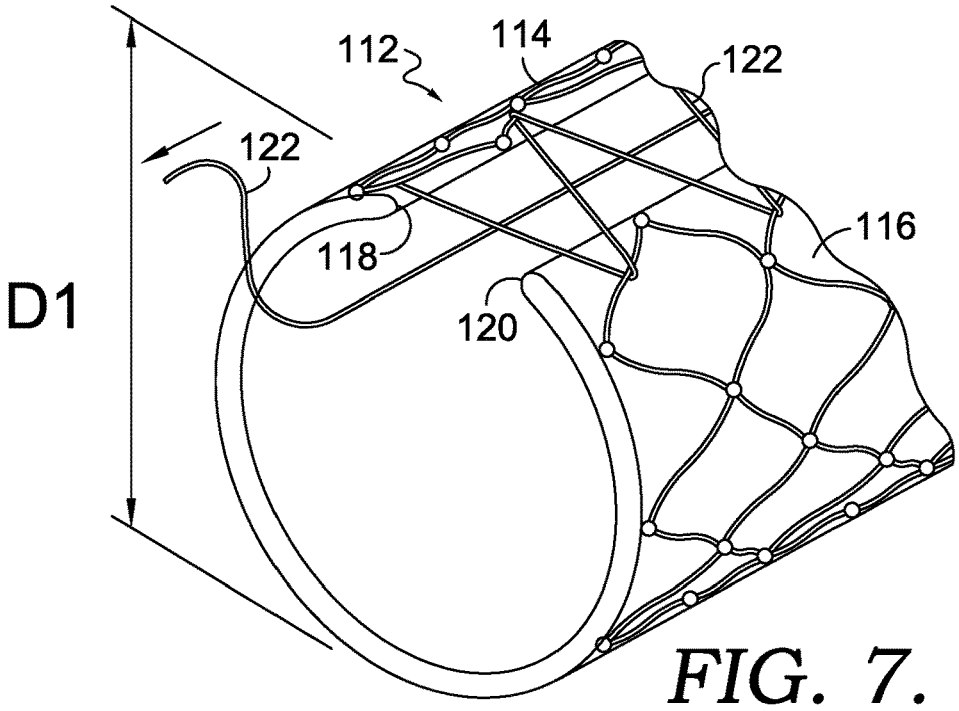
FIG. 7 depicts a perspective view of an exemplary section of the double-layer, single tube braided structure of claim 6, along line 7-7, in accordance with aspects herein.
Figure 9:
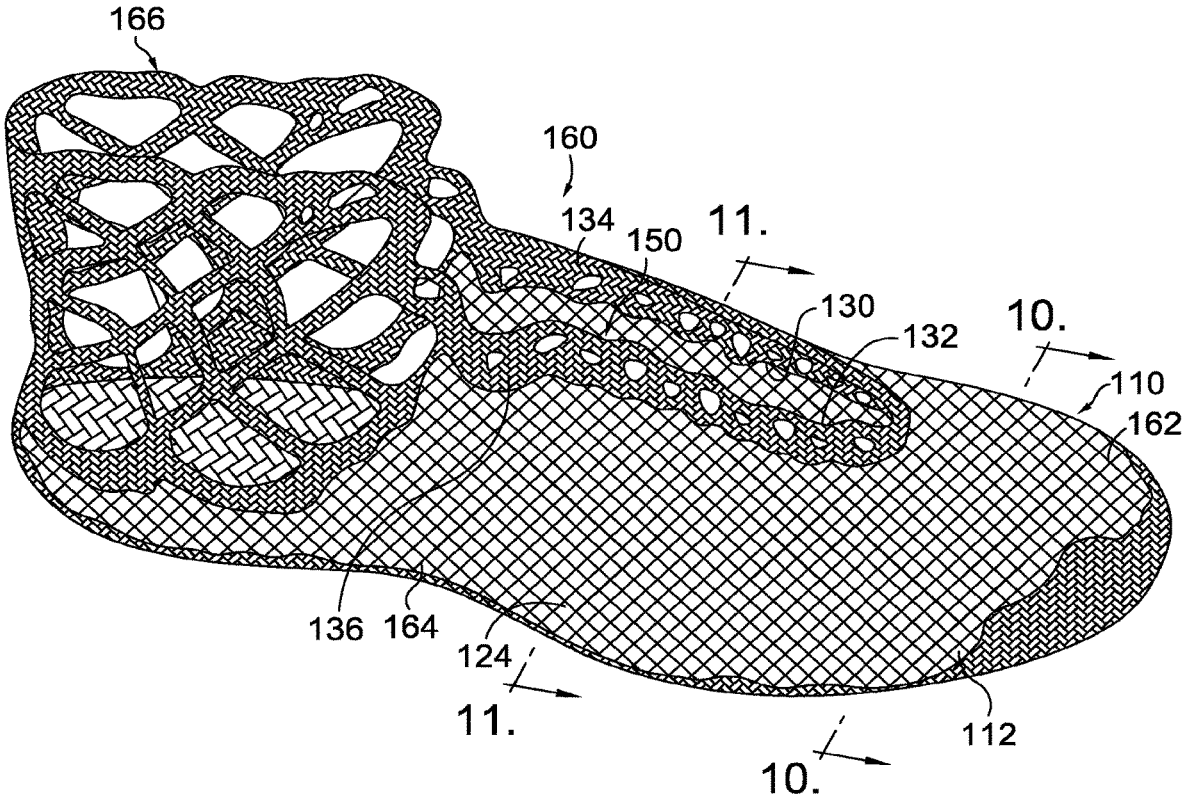
FIG. 9 depicts a perspective view of an exemplary shoe upper formed from a double-layer, single-tube braided structure, shown in an expanded configuration, formed in accordance with aspects herein.
Figure 11:
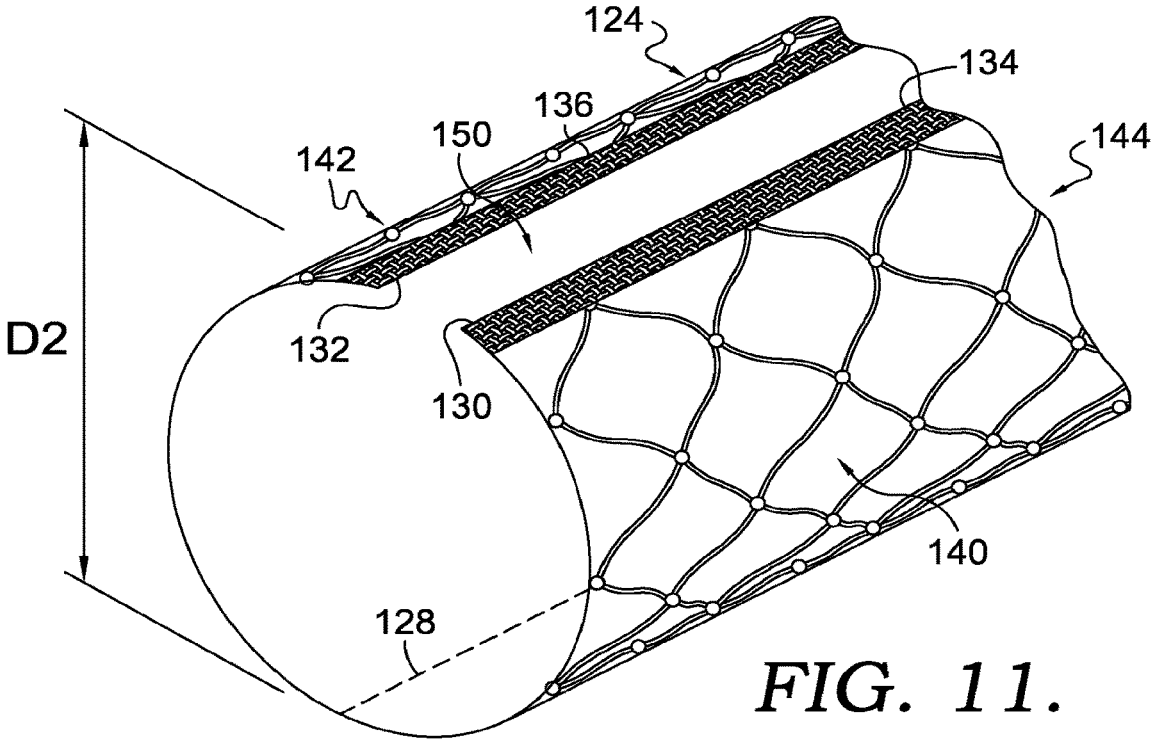
FIG. 11 depicts a perspective view of the an exemplary section of FIG. 9, along line 11-11, with the draw yarn removed and the tubular structure expanded, in accordance with aspects herein.

An exemplary braided upper 160 is shown in FIG. 9, showing the double-layer tubular braided structure 110 with the draw yarn(s) 122 removed, and in the expanded condition. As indicated by line 10-10, the braided upper 160 has a section formed from the braided structure 110 with a toe area 162 formed as described with respect to FIGS. 7 and 10. Toe area 162 thus has the single-layer closed tube described with respect to FIG. 10, and formed as described with respect to FIGS. 6 and 7 by removing the draw yarn(s) 122. Similarly, as indicated by line 11-11, the braided upper 160 has a section formed from the braided section 110 with a mid-foot area 164 formed as described with respect to FIGS. 8 and 11. Mid-foot area 164 thus has the single-layer construction with finished edges 130, 132 forming a throat opening 150 as described with respect to FIGS. 8 and 11, by removing the draw yarn(s) 122 described in FIG. 8. The remainder of the braided upper 160 can be formed with a similar construction, leaving an open collar area 166.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A method of manufacturing a tubular braided structure for a braided footwear upper, the method of manufacturing comprising:

generating a two-layer, single-tube braided structure having at least a first end braided with at least one first yarn integrally braided with the tubular braided structure, at least a second end braided with the at least one first yarn integrally braided with the tubular braided structure, and at least one draw yarn removably braided with the at least one first yarn to removably couple the first end and the second end; and removing at least a portion of the at least one draw yarn from the first end and the second end, wherein upon removal of the at least a portion of the at least one draw yarn from the first end and the second end, a first layer of the two-layer, single-tube braided structure forms a lateral side of the braided footwear upper, a second layer of the two-layer, single-tube braided structure forms a medial side of the braided footwear upper, the first end forms a top center of the braided footwear upper, and the second end forms a bottom center of the braided footwear upper.

2. The method of manufacturing of claim 1, further wherein at a second portion of the first end, the first layer comprises a first finished braided edge and the second layer comprises a second finished braided edge, such that at the second portion of the first end, the first finished braided edge and the second finished braided edge are not braided together absent the at least one draw yarn.

3. The method of manufacturing of claim 2, further comprising braiding the first finished braided edge and the second finished braided edge with a higher density braid configuration band of a selected width.

4. The method of manufacturing of claim 2, wherein upon removal of the at least a portion of the at least one draw yarn from the first end and the second end, the tubular braided structure comprises an open throat area defined by the first finished braided edge and the second finished braided edge.

5. A method of manufacturing a tubular braided structure for a braided footwear upper, the method of manufacturing comprising:

generating a two-layer, single-tube braided structure having at least a first end braided with at least one first yarn integrally braided with the tubular braided structure, at least a second end braided with the at least one first yarn integrally braided with the tubular braided structure, and at least one draw yarn removably braided with the at least one first yarn to removably couple the first end and the second end;

removing at least a portion of the at least one draw yarn from the tubular braided structure; and wherein upon removal of the at least a portion of the at least one draw yarn from the tubular braided structure, the first end forms a top center of the braided footwear upper, and the second end forms a bottom center of the braided footwear upper.

6. The method of manufacturing of claim 5, further wherein at a second portion of the first end, a first layer of the tubular braided structure comprises a first finished braided edge and a second layer of the tubular braided structure comprises a second finished braided edge, such that at the second portion of the first end, the first finished braided edge and the second finished braided edge are not braided together absent the at least one draw yarn.

7. The method of manufacturing of claim 6, further comprising braiding the first finished braided edge and the second finished braided edge with a higher density braid configuration band of a selected width.

8. The method of manufacturing of claim 6, wherein upon removal of the at least a portion of the at least one draw yarn from the tubular braided structure, the tubular braided structure comprises an open throat area defined by the first finished braided edge and the second finished braided edge.

9. The method of manufacturing of claim 6, wherein the first layer of the tubular braided structure and the second layer of the tubular braided structure are braided together such that the second end is a closed end coupling the first layer and the second layer.

* * * * *